US005172579A

United States Patent [19]

Nojima

[11] Patent Number: 5,172,579

[45] Date of Patent: Dec. 22, 1992

[54] STEERING CONTROL APPARATUS FOR ROLLED PLATES

[75] Inventor: Akira Nojima, Koganei, Japan

[73] Assignee: Kabushiki Kaisha Toshiba, Kawasaki, Japan

[21] Appl. No.: 700,178

[22] PCT Filed: Jul. 31, 1990

[86] PCT No.: PCT/JP90/00977

§ 371 Date: May 21, 1991

§ 102(e) Date: May 21, 1991

[87] PCT Pub. No.: WO91/01827

PCT Pub. Date: Feb. 21, 1991

[30] Foreign Application Priority Data

Jul. 31, 1989 [JP] Japan ..... 1-198407
Jul. 31, 1989 [JP] Japan ..... 1-198408

[51] Int. Cl.[5] ..... B21B 37/12; G06F 15/46; G05B 13/02

[52] U.S. Cl. ..... 72/8; 72/11; 364/157; 364/161; 364/472

[58] Field of Search ..... 72/8-12, 72/17, 20, 241.2, 241.4, 245; 364/148, 152, 153, 157, 158, 160-163, 472

[56] References Cited

U.S. PATENT DOCUMENTS 3,622,767 11/1971 Koepcke ..... 364/160
4,537,050 8/1985 Bryant et al. ..... 72/12
4,700,312 10/1987 Kikuma et al. ..... 72/8
4,754,410 6/1988 Leech et al. ..... 364/158
4,903,192 2/1990 Saito et al. ..... 364/157
5,043,862 8/1991 Takahashi et al. ..... 364/148

FOREIGN PATENT DOCUMENTS 0149014 9/1982 Japan .
0016527 4/1984 Japan .
0144208 7/1986 Japan ..... 72/8
0253109 11/1986 Japan ..... 72/12
0241006 11/1987 Japan ..... 364/157
0119802 5/1989 Japan ..... 364/157

*Primary Examiner*—Lowell A. Larson
*Assistant Examiner*—Thomas C. Schoeffler
*Attorney, Agent, or Firm*—Foley & Lardner

[57] ABSTRACT

A steering control apparatus for a rolled plate (1) rolled by a rolling mill (2), and which has a means (15) for obtaining by means of fuzzy inference a leveling amount of its polarity (15*A*) of the rolling mill for the snaking control of the rolled plate, in accordance with a tension difference (11*A*) between the operator side tension and the drive side tension of the rolled plate and a rolling load difference (13*A*) between the operator side rolling load and the drive side rolling load of the rolling mill. In accordance with the leveling amount and polarity obtained by means of the fuzzy inference, the leveling amount of the rolling mill (2) is regulated independently for the operator side and drive side.

5 Claims, 5 Drawing Sheets

STEERING CONTROL APPARATUS FOR ROLLED PLATES

TECHNICAL FIELD OF THE INVENTION

The present invention relates to a steering control apparatus for a plate rolled by a tandem rolling mill.

CONVENTIONAL TECHNIQUE

There is known a steering control apparatus for rolled plates, such as shown in FIG. 1. The steering control apparatus shown in FIG. 1 performs a steering control for a plate 101 rolled by a rolling mill 102, i.e., it controls to correct a deviation of the rolled plate 101 in the direction of its flow. At the exit side of the rolling mill 102, there are disposed a tension detector 103 at the operator side and a tension detector 104 at the drive side. The detectors 103 and 104 detect a tension 103A at the operator side and a tension 104A at the drive side. A difference, i.e., tension difference 111A=103A−104A between the tensions 103A and 104A is calculated by a subtracter 111. The tension difference 111A is supplied to a dead zone device 112 having a dead zone of a small difference range and set with a dead zone, and the output of the dead zone device 112 is supplied to a proportional integrator 113.

The dead zone device performs a dead zone process and outputs a tension difference ΔT from the following equations:

$$\text{If } T_{UL} < \Delta T_i, \text{ then } \Delta T = \Delta T_i - T_{UL} \quad (1)$$

$$\text{If } T_{LL} \leqq \Delta T_i \leqq T_{UL}, \text{ then } \Delta T = 0 \quad (2)$$

$$\text{If } T_i < T_{LL}, \text{ then } \Delta T = \Delta T_i - T_{LL} \quad (3)$$

where $\Delta T_i$ is a value of the tension difference 111A, ΔT is a value of the tension difference 112A after the dead zone process, $T_{UL}$ is an upper limit of the dead zone, and $T_{LL}$ is a lower limit of the dead zone.

The proportional integrator 113 performs a proportional integration operation of the tension difference 112A and outputs the result as a leveling amount 113A for correcting the snaking of the rolled plate 101. An absolute value limiter 114 limits the absolute value of the leveling amount 113A so as not to make it exceed a limit value, and outputs it as a limited leveling amount. A subtracter 115 subtracts the limited leveling amount 114A from an operator side roll gap position reference value 117A set by an operator side roll gap position reference value setter 117, to thereby output a leveling-amount-corrected operator side roll gap position reference value 115A. An adder 116 adds the limited leveling amount 114A to a drive side roll gap position reference value 118A set by a drive side roll gap position reference value setter 118, to thereby output a leveling-amount-corrected drive side roll gap position reference value 116A.

In accordance with the operator side roll gap position reference value 115A, an operator side roll gap position controller 109 and an operator side roll gap position driver 107 regulate the operator side roll gap position of the rolling mill 102. Similarly, in accordance with the drive side roll gap position reference value 116A, a drive side roll gap position controller 110 and a drive side roll gap position driver 108 regulate the driver side roll gap position of the rolling mill 102.

The operator side roll gap position driver 107 is equipped with a rolling load detector 105 for detecting an operator side rolling load of the rolling mill 102, whereas the drive side roll gap position driver 108 is equipped with a rolling load detector 106 for detecting a drive side rolling load of the rolling mill 102. The rolling loads detected by the detectors are used for feedback control of the rolling loads by load controllers (not shown).

With the steering control apparatus constructed as above, if the operator side tension 103A detected by the tension detector 103 is larger than the drive side tension 104A detected by the tension detector 104, the extension of the plate 101 rolled at the operator side is less than that at the drive side so it is judged that the rolled plate 101 snakes or shifts to the operator side. In order to correct this snaking, the leveling-amount-corrected operator side roll gap position reference value 115A is made small on one hand (i.e., the screw-down amount at the operator side is made large and so the roll gap is made small), and the leveling-amount-corrected drive side roll gap position reference value 116A is made large on the other hand (i.e., the screw-down amount at the drive side is made small so the roll gap is made large). In this manner, the roll gap control of the rolling mill 102 continues until the extension of the rolled plate 101 at the operator side becomes equal to that at the drive side, namely, until the operator side tension 103A becomes equal to the drive side tension 104A.

With the conventional steering control apparatus described above, a proportional integration control of one-input/one-output type is used wherein a difference, i.e., tension difference ΔT between the operator side tension 103A and the drive side tension 104A of the rolled plate at the exit side of the rolling mill 102 is used as an input and the leveling amount 113A of the rolling mill 102 is used as an output in such a manner that the tension difference ΔT becomes zero. With this arrangement, the leveling amount of the rolling mill 102 may sometimes increase up to the mechanical upper limit of the rolling mill 102 while the tension difference ΔT is made to become zero. As the leveling amount of the rolling mill 102 increases, the difference between the operator side rolling load and the drive side rolling load of the rolling mill 102 becomes large correspondingly, thereby sometimes giving adverse effects on the cross sectional shape of the rolled plate 101.

In other words, the conventional steering apparatus uses a proportional integration control system of one-input/one-output type wherein a difference (i.e., tension difference) between the operator side tension and the drive side tension of the rolled plate 101 is used as a control input and the leveling amount of the rolling mill 102 is used as a control output. Therefore, a difference between the operator side rolling load and the drive side rolling load of the rolled mill 102 cannot be controlled.

SUMMARY OF THE INVENTION

It is therefore an object of the present invention to provide a steering control apparatus for a rolled plate capable of performing an optimum steering control by which a difference between the operator side rolling load and the drive side rolling load of a rolling mill does not become so excessive that adverse effects will be given to the shape of the rolled plate, even if a tension difference of the rolled plate continues to be present between the operator side and the drive side.

In order to achieve the above object, the present invention provides a steering control apparatus for a rolled plate comprising: tension detecting means for detecting an operator side tension and a drive side tension, respectively of a plate rolled by a rolling mill; rolling load detecting means for detecting an operator side rolling load and a drive side rolling load, respectively of the rolling mill; first calculation means for calculating a tension difference between the operator side tension and the drive side tension, respectively detected by the tension detecting means; second calculation means for calculating a rolling load difference between the operator side rolling load and the drive side rolling load, respectively detected by the rolling load detecting means; third calculation means for obtaining by means of a fuzzy inference scheme a leveling amount and its polarity of the rolling mill for the steering control of the rolled plate, in accordance with the tension difference calculated by the first calculation means and the rolling load difference calculated by the second calculation means; and means for regulating the leveling amount of the rolling mill independently for the operator side and the drive side, in accordance with the leveling amount and the polarity calculated by the third calculation means.

The reason why a conventional steering control apparatus gives adverse effects on the cross sectional shape of a rolled plate is that the leveling amount of the rolling mill is determined by a one-input/one-output proportional integration control system in order only to make zero the tension difference of the rolled plate between the operator side and the drive side.

According to the present invention, when there is present a tension difference of a rolled plate between the operator side and the drive side, the rolling load difference of the rolling mill between the operator side and the drive side at that time is considered for determining the leveling amount by means of a fuzzy inference scheme. This leveling amount is used for controlling the roll gap position control system to thereby control the snaking of the rolled plate.

Specifically, the following cases (a) to (d) are considered which are combinations of the tension difference polarity and rolling load polarity.

Specifically, in the embodiment shown in FIG. 4, (a) If the operator side tension of the rolled plate is larger than the drive side tension and the operator side rolling load of the rolling mill is larger than the drive side rolling load, the leveling amount is set by means of the fuzzy control scheme such that it slightly increases the screw-down degree of the rolling mill at the operator side (makes the roll gap small).

(b) If the operator side tension of the rolled plate is larger than the drive side tension and the operator side rolling load of the rolling mill is smaller than the drive side rolling load, the leveling amount is set by means of the fuzzy control scheme such that it greatly increases the screw-down degree of the rolling mill at the operator side.

(c) If the operator side tension of the rolled plate is smaller than the drive side tension and the operator side rolling load of the rolling mill is larger than the drive side rolling load, the leveling amount is set by means of the fuzzy control scheme such that it greatly increases the screw-down degree of the rolling mill at the drive side.

(d) If the operator side tension of the rolled plate is smaller than the drive side tension and the operator side rolling load of the rolling mill is smaller than the drive side rolling load, the leveling amount is set by means of the fuzzy control scheme such that it slightly increases the screw-down degree of the rolling mill at the drive side.

In the above manner, in accordance with the tension difference of a rolled plate between the operator side and the drive side and the rolling load difference of the rolling mill between the operator side and the drive side, an optimum leveling amount is obtained by means of the fuzzy control means, to thereby perform an optimum steering control for the rolled plate without adversely affecting the cross sectional shape of the rolled plate.

BRIEF DESCRIPTION OF THE DRAWINGS

In the accompanying drawings.

DETAILED DESCRIPTION OF THE PREFERRED EMBODIMENTS

The embodiments of the present invention will be described with reference to the accompanying drawings.

Figure 1:
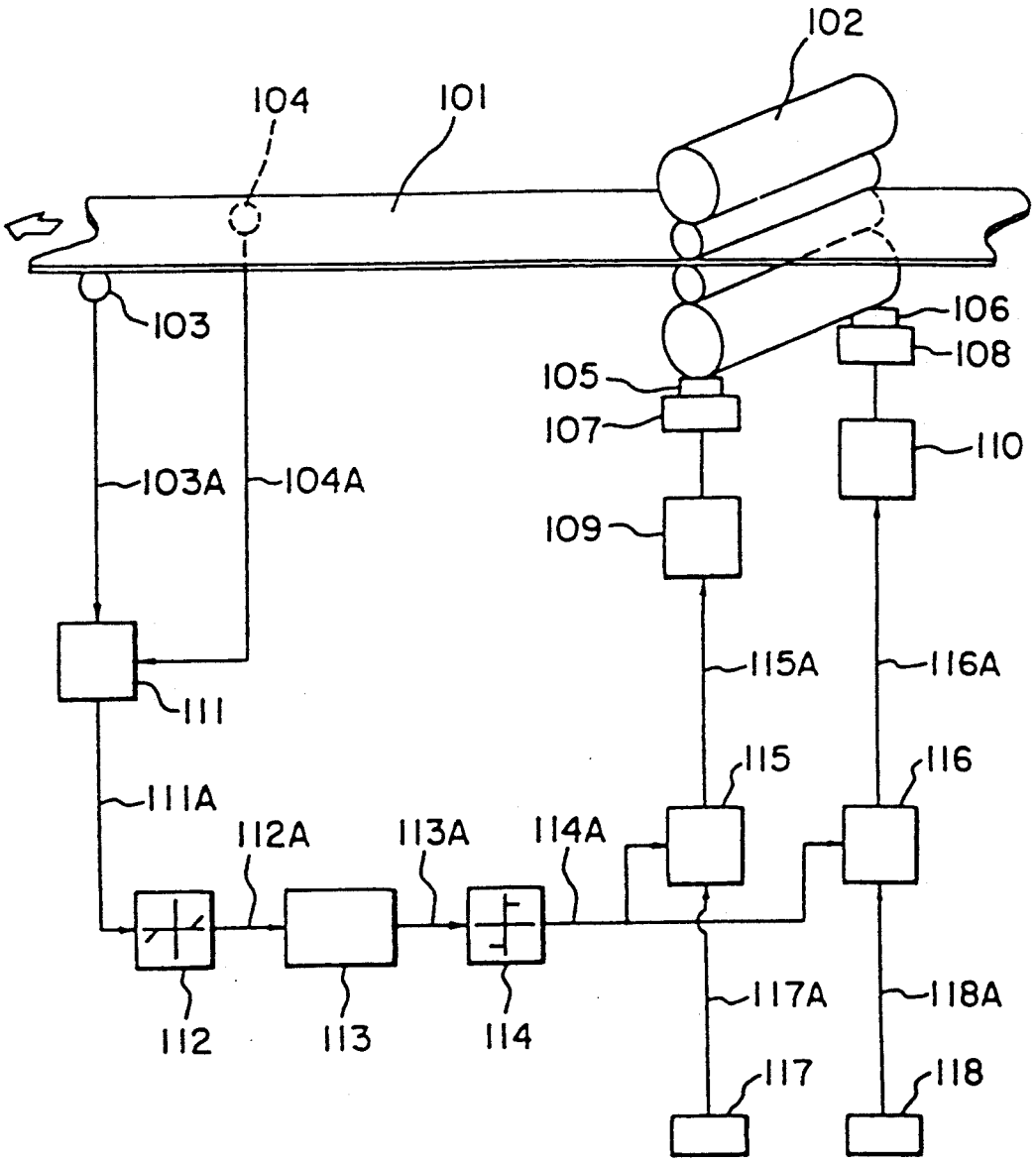
FIG. 1 PRIOR ART
FIG. 1 is a block diagram showing a conventional steering control apparatus for a rolled plate.
Figure 2:
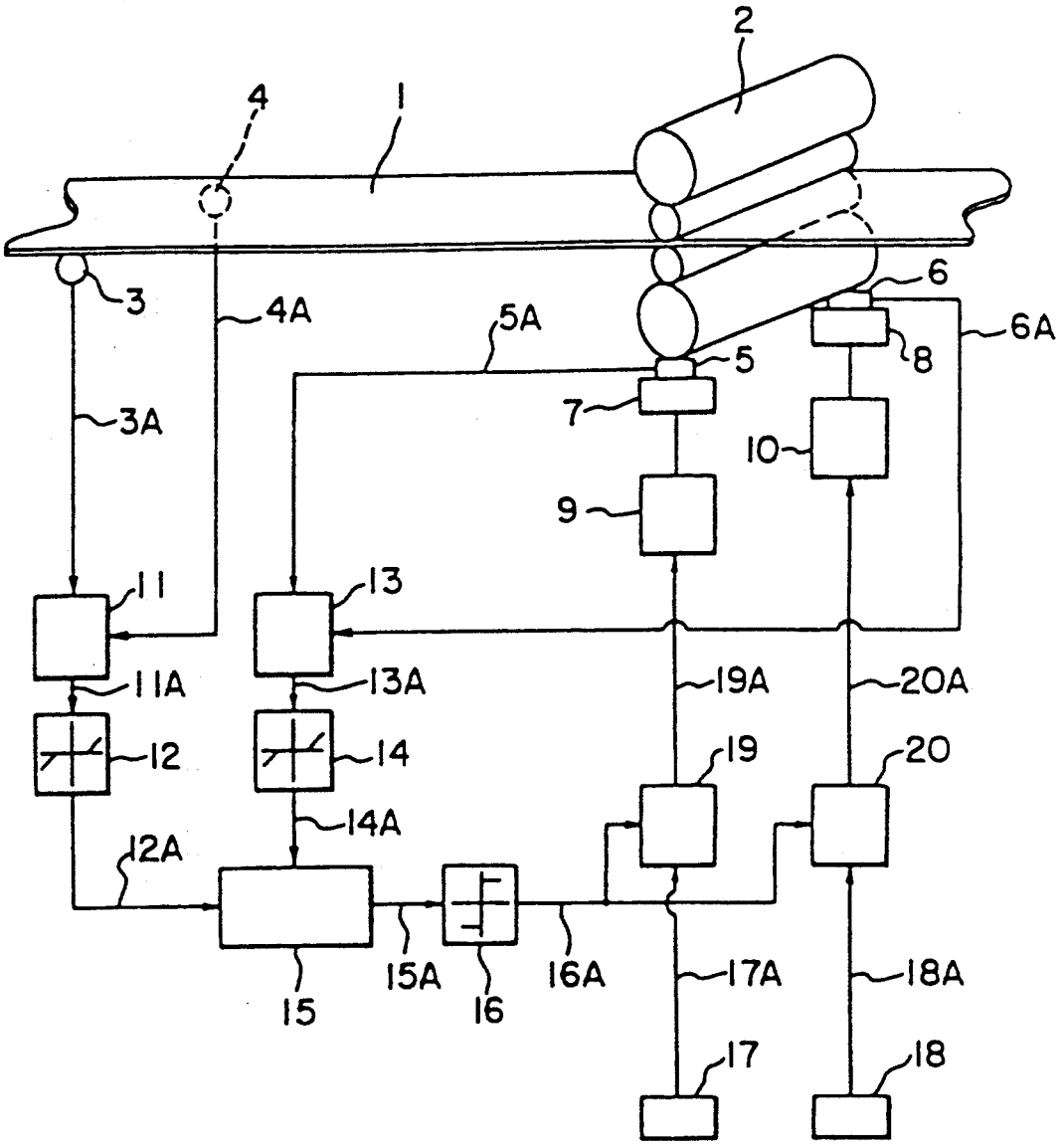
FIG. 2 is a block diagram showing a steering control apparatus for a rolled plate according to a first embodiment of this invention.

FIG. 2 shows a steering control apparatus of the first embodiment of this invention. In the steering control apparatus shown in FIG. 2, an operator side tension 3A and a drive side tension 4A of a plate rolled by and discharged from a rolling mill 2 are detected by an operator side tension detector 3 and a drive side tension detector 4, respectively. A difference, i.e., tension difference 11A (=3A−4A) between the tensions 3A and 4A detected by the detectors 3 and 4 is calculated by a subtracter 11. The tension difference 11A is supplied to a dead zone device 12 having a dead zone of a small difference range and set with the dead zone, and the output of the dead zone device 12 is input to a first input terminal of a fuzzy inference device 15. The dead zone device 12 performs a dead zone process of the tension difference 11A, i.e., $\Delta Ti$ in accordance with the equations (1) to (3) described previously, and outputs a dead-zone-processed tension difference 12A.

An operator side rolling load 5A and a drive side rolling load 6A of the rolling mill 2 are detected by an operator side rolling load detector 5 and a drive side rolling load detector 6, respectively. A difference (5A−6A) between the rolling loads 5A and 6A is calculated by a subtracter 13 and output as a rolling load difference 13A. The rolling load difference 13A is supplied to a dead zone device 14 having a dead zone of a small difference range and set with the dead zone, and the output of the dead zone device 14 is input to a second input terminal of the fuzzy inference device 15. The dead zone device 14 is constructed in accordance with the same principle as that of the dead zone device 12 already described. The dead zone device 14 performs a dead zone process and outputs a rolling load difference ΔP from the following equations:

$$\text{If } P_{UL} < \Delta P_i, \text{ then } \Delta P = \Delta P_i - P_{UL} \quad (4)$$

$$\text{If } P_{LL} \leqq \Delta P_i \leqq P_{UL}, \text{ then } \Delta P = 0 \quad (5)$$

$$\text{If } P_i < P_{LL}, \text{ then } \Delta P = \Delta P_i - P_{LL} \quad (6)$$

where ΔPi is a value of the rolling load difference 13A, ΔP is a value of the rolling load difference 14A after the dead zone process, $P_{UL}$ is an upper limit of the dead zone, and $P_{LL}$ is a lower limit of the dead zone.

In accordance with the tension difference 12A after the dead zone process and the rolling load difference 14A after the dead zone process, the fuzzy inference device 15 calculates a leveling amount 15A of the rolling mill 2 by means of fuzzy inference. The fuzzy inference scheme by the fuzzy inference device 15 will be described later in detail.

An upper/lower limiter 16 performs an upper/lower limit process of the leveling amount 15A calculated by the fuzzy inference 15, and outputs an upper/lower limited leveling amount 16A. The upper/lower limiter 16 is provided because the leveling amount of the rolling mill 2 has mechanical upper and lower values.

The leveling amount 16A thus obtained is used for correcting a roll gap position reference of the rolling mill 2. Specifically, an operator side roll gap position reference 19A (=17A−16A) is calculated on one hand by a subtracter 19 by subtracting the leveling amount 16A from an operator side roll gap position reference 17A set by an operator side roll gap position reference setter 17, and a drive side roll gap position reference 20A (=18A+16A) is calculated on the other hand by an adder 20 by adding the leveling amount 16A to a drive side roll gap position reference 18A set by a drive side roll gap position reference setter 18.

In accordance with the operator side roll gap position reference 19A, an operator side roll gap position controller 9 and an operator side roll gap position driver 7 regulate the operator side roll gap position of the rolling mill 2. Similarly, in accordance with the drive side roll gap position reference value 20A, a drive side roll gap position controller 10 and a drive side roll gap position driver 9 regulate the drive side roll gap position of the rolling mill 102.

Next, the fuzzy control scheme performed by the fuzzy inference device 15 of the apparatus shown in FIG. 2 will be described.

Figure 3:
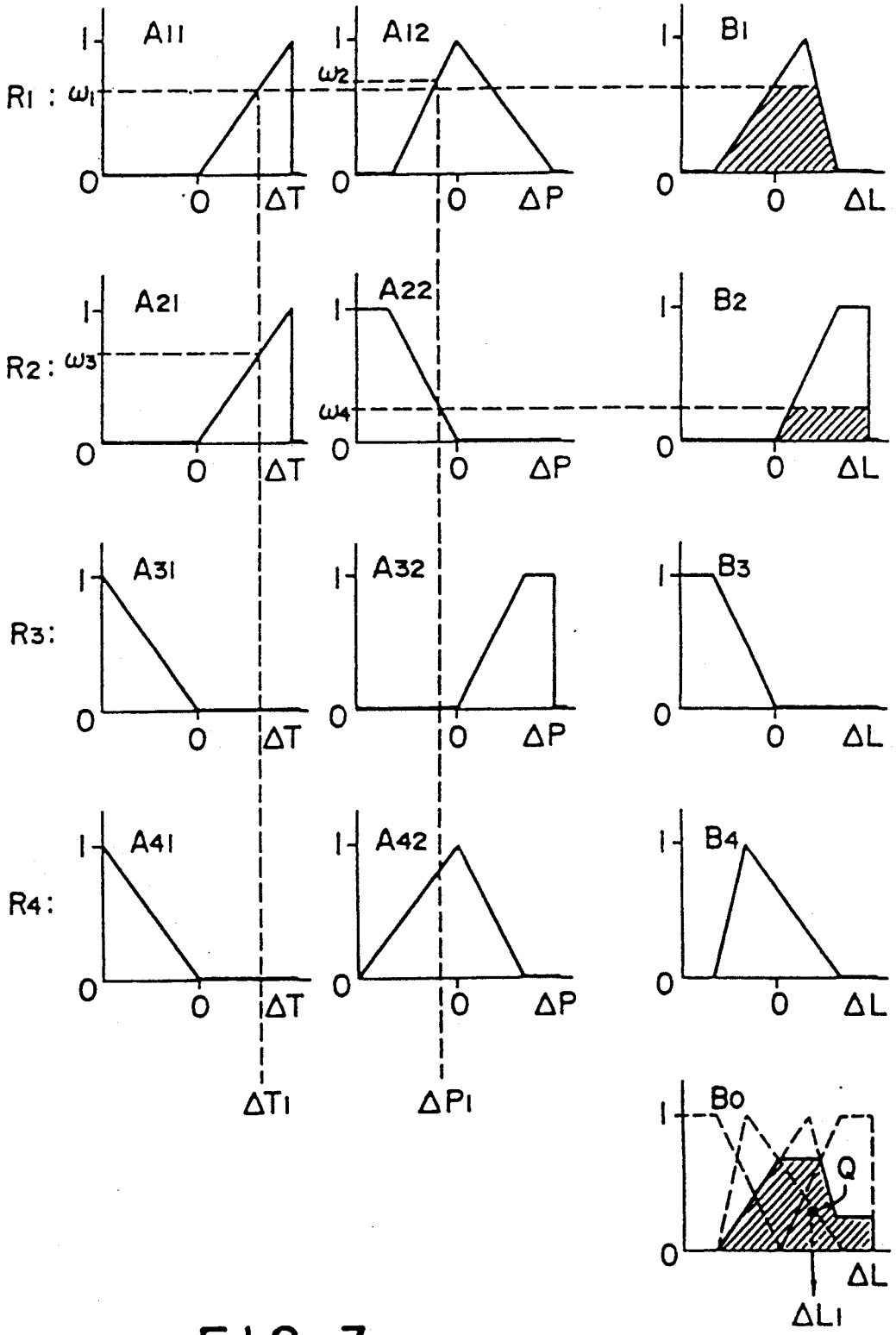
FIG. 3 shows diagrams used for explaining the operation of fuzzy inference for the steering control apparatus shown in FIG. 2.

Fuzzy control rules and membership functions used by the fuzzy inference device 15 are shown in FIG. 3. Symbols $A_{11}$, $A_{12}$, $A_{21}$, $A_{22}$, $A_{31}$, $A_{32}$, $A_{41}$, $A_{42}$, $B_1$, $B_2$, $B_3$, and $B_4$ represent membership functions, and symbols $R_1$, $R_2$, $R_3$, and $R_4$ represent fuzzy control rules. The description will be given assuming that an inference scheme with a minimum calculation method is used.

An input (premise) for the inference is the tension difference 12A and the rolling load difference 14A, and an output (conclusion) is the leveling amount 15A of the rolling mill. The input (premise) and output (conclusion) are related to each other by the fuzzy control rules $R_1$, $R_2$, $R_3$, and $R_4$. The tension difference 12A is represented by ΔT ($\Delta T_1$ is a particular value of ΔT), the rolling load difference 14A is represented by ΔP ($\Delta P_1$ is a particular value of ΔP), and the leveling amount 15A is represented by ΔL ($\Delta L_1$ is a particular value of ΔL). Then, (premise): $\Delta T = \Delta T_1$ and $\Delta P = \Delta P_1$, (fuzzy control rules)

$R_1$: if $\Delta T = A_{11}$ and $\Delta P = A_{12}$, then $\Delta L = B_1$, $R_2$: if $\Delta T = A_{21}$ and $\Delta P = A_{22}$, then $\Delta L = B_2$, $R_3$: if $\Delta T = A_{31}$ and $\Delta P = A_{32}$, then $\Delta L = B_3$, $R_4$: if $\Delta T = A_{41}$ and $\Delta P = A_{42}$, then $\Delta L = B_4$, and (conclusion): combining all the membership functions $B_1$, $B_2$, $B_3$, and $B_4$, it stands that $\Delta L = \Delta L_1$.

The fuzzy control rules and membership functions described above will be detailed with reference to FIG. 3.

Fuzzy control rule $R_1$

The membership function $A_{11}$ indicates the degree that the operator side tension 3A is larger than the drive side tension 4A. The abscissa represents the tension difference 11A (=ΔT=3A−4A), and the ordinate represents an adaptation degree.

The membership function $A_{12}$ indicates to what degree the operator Side rolling load can be changed when the operator side rolling load 5A is larger than the drive side rolling load 6A. The abscissa represents the rolling load difference 13A (=ΔP=5A−6A), and the ordinate represents an adaptation degree.

The membership function $B_1$ is used for setting a leveling amount 15A such that the screw-down degree of the rolling mill 2 is slightly increased at the operator side. The adaptation degree of the membership function $A_{11}$ at a particular tension difference $\Delta T_1$ is compared with the adaptation degree of the membership function $A_{12}$ at a particular rolling load difference $\Delta P_1$, and the membership function $B_1$ is cut out at the smaller adaptation degree. The ΔL coordinate of the center of gravity of the shape of the cut-out membership function $B_1$ is the leveling amount 15A of the rolling mill 2 inferred by the fuzzy control rule $R_1$ (the leveling amount taking a positive value in the direction that the screw-down degree is increased at the operator side).

Fuzzy control rule $R_2$

The membership function $A_{21}$ indicates the degree that the operator side tension 3A is larger than the drive side tension 4A. The abscissa represents the tension difference 11A (=ΔT=3A - 4A), and the ordinate represents an adaptation degree.

The membership function $A_{22}$ indicates to what degree the operator side rolling load can be changed when the drive side rolling load 6A is larger than the operator side rolling load 5*a*. The abscissa represents the rolling load difference 13A (=ΔP=5A−6A), and the ordinate represents an adaptation degree.

The membership function $B_2$ is used for setting a leveling amount 15A such that the screw-down degree of the rolling mill 2 is greatly increased at the operator side. The adaptation degree of the membership function $A_{21}$ at a particular tension difference $\Delta T_1$ is compared with the adaptation degree of the membership function $A_{22}$ at a particular rolling load difference $\Delta P_1$, and the membership function $B_2$ is cut out at the smaller adaptation degree. The ΔL coordinate of the center of gravity of the shape of the cut-out membership function $B_2$ is the leveling amount 15A of the rolling mill 2 inferred by the fuzzy control rule $R_2$ (the leveling amount taking a positive value in the direction that the screw-down degree is increased at the operator side).

Fuzzy control rule $R_3$

The membership function $A_{31}$ indicates the degree that the drive side tension 4A is larger than the operator side tension 3A. The abscissa represents the tension difference 11A ($=\Delta T=3A-4A$), and the ordinate represents an adaptation degree.

The membership function $A_{32}$ indicates to what degree the drive side rolling load can be changed when the operator side rolling load 5A is larger than the drive side rolling load 6A. The abscissa represents the rolling load difference 13A ($=\Delta P=5A-6A$), and the ordinate represents an adaptation degree.

The membership function $B_3$ is used for setting such a leveling amount 15A that the screw-down degree of the rolling mill 2 is greatly increased at the drive side. The adaptation degree of the membership function $A_{31}$ at a particular tension difference $\Delta T_1$ is compared with the adaptation degree of the membership function $A_{32}$ at a particular rolling load difference $\Delta P_1$, and the membership function $B_3$ is cut out at the smaller adaptation degree. The $\Delta L$ coordinate of the center of gravity of the shape of the cut-out membership function $B_3$ is the leveling amount 15A of the rolling mill 2 inferred by the fuzzy control rule $R_3$ (the leveling amount taking a positive value in the direction that the screw-down degree is increased at the operator side).

Fuzzy control rule $R_4$

The membership function $A_{41}$ indicates the degree that the drive side tension 4A is larger than the operator side tension 3A. The abscissa represents the tension difference 11A ($=\Delta T=3A-4A$), and the ordinate represents an adaptation degree.

The membership function $A_{42}$ indicates to what degree the drive side rolling load can be changed when the drive side rolling load 6A is larger than the operator side rolling load 5A. The abscissa represents the rolling load difference 13A ($=\Delta P=5A-6A$), and the ordinate represents an adaptation degree.

The membership function $B_4$ is used for setting such a leveling amount 15A that the screw-down degree of the rolling mill 2 is slightly increased at the drive side. The adaptation degree of the membership function $A_{41}$ at a particular tension difference $\Delta T_1$ is compared with the adaptation degree of the membership function $A_{42}$ at a particular rolling load difference $\Delta P_1$, and the membership function $B_4$ is cut out at the smaller adaptation degree. The $\Delta L$ coordinate of the center of gravity of the shape of the cut-out membership function $B_4$ is the leveling amount 15A of the rolling mill 2 inferred by the fuzzy control rule $R_4$ (the leveling amount taking a positive value in the direction that the screw-down degree is increased at the operator side).

The $\Delta L$ coordinate ($=\Delta L_1$) of the center of gravity Q of the shape of a new membership function $B_0$ obtained by superposing the membership functions $B_1$, $B_2$, $B_3$, and $B_4$ cut off by the fuzzy control rules $R_1$, $R_2$, $R_3$, and $R_4$ and indicating the leveling amount 15A, becomes a set value of the leveling amount 15A of the rolling mill 2 inferred by the fuzzy control rules $R_1$, $R_2$, $R_3$, and $R_4$.

The procedure for obtaining the leveling amount $\Delta L_1$ will be described with reference to FIG. 3 assuming that the tension difference $\Delta T$ is $\Delta T_1$ and the rolling load difference $\Delta P$ is $\Delta P_1$.

Inference by the fuzzy Control rule $R_1$

If $\Delta T=\Delta T_1$, the adaptation degree obtained by the membership function $A_{11}$ is $\omega_1$.

If $\Delta P=\Delta P_1$, the adaptation degree obtained by the membership function $A_{12}$ is $\omega_2$.

Since $\omega_1<\omega_2$ in this case, the membership function $B_1$ is cut out at the adaptation degree $\omega_1$ so that the hatching portion of the membership function $B_1$ indicates the leveling amount 15A inferred by the fuzzy control rule $R_1$.

Inference by the fuzzy control rule $R_2$

If $\Delta T=\Delta T_1$, the adaptation degree obtained by the membership function $A_{21}$ is $\omega_3$.

If $\Delta P=\Delta P_1$, the adaptation degree obtained by the membership function $A_{22}$ is $\omega_4$.

Since $\omega_4<\omega_3$ in this case, the membership function $B_2$ is cut out at the adaptation degree so that the hatching portion of the membership function $B_2$ indicates the leveling amount 15A inferred by the fuzzy control rule $R_2$.

Inference by the fuzzy control rule $R_3$

If $\Delta T=\Delta T_1$, the adaptation degree obtained by the membership function $A_{31}$ is 0. Therefore, there is no membership function which indicates the leveling amount 15A inferred by the fuzzy control rule $R_3$.

Inference by the fuzzy control rule $R_4$

If $\Delta T=\Delta T_1$, the adaptation degree obtained by the membership function $A_{41}$ is 0. Therefore, there is no membership function which indicates the leveling amount 15A inferred by the fuzzy control rule $R_4$.

The $\Delta L$ coordinates of the center of gravity Q of the shape of a membership function $B_0$ obtained by superposing the hatching portions of the membership functions $B_1$ and $B_2$ indicating the leveling amounts 15A and inferred by the fuzzy control rules $R_1$ and $R_2$, respectively, becomes a set value of the leveling amount 15A of the rolling mill 2 for correcting the snaking thereof, for the case of $\Delta T=\Delta T_1$ and the rolling load difference $\Delta P=\Delta P_1$.

With the steering control apparatus shown in FIG. 2, the roll gap control system is directly controlled by the leveling amount determined by means of the fuzzy control scheme. A different embodiment will be described.

Figure 4:
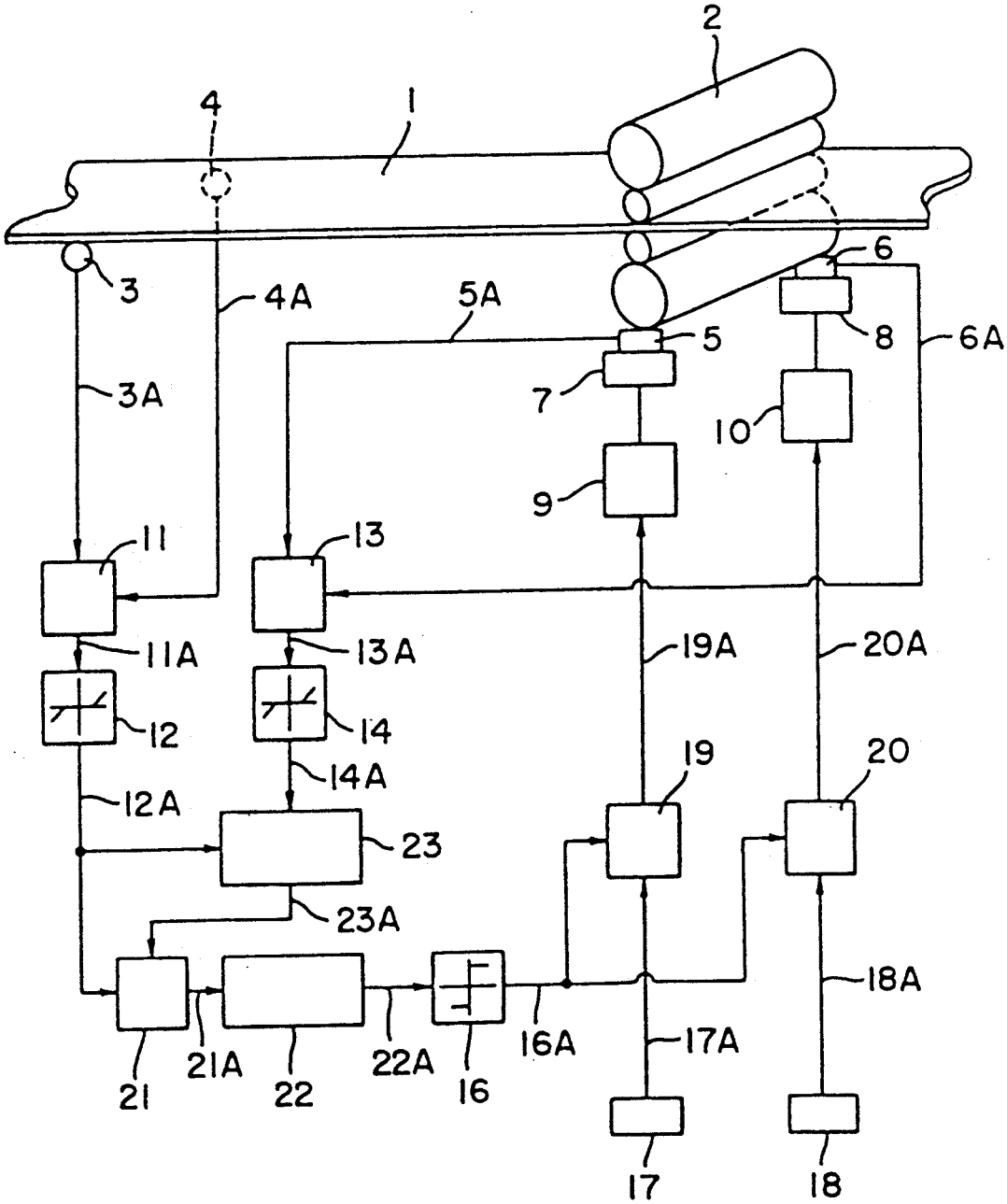
FIG. 4 is a block diagram showing a steering control apparatus for a rolled plate according to a second embodiment of this invention.

FIG. 4 shows the second embodiment of this invention.

In this embodiment, an optimum gain of the proportional integration system is calculated and set in real time by means of the fuzzy inference scheme, in accordance with the tension difference of a rolled plate between the operator side and the drive side at the exit of the rolling mill and the rolling load difference of the rolling mill between the operator side and the drive side.

Specifically, in the embodiment shown in FIG. 4, (a) If the operator side tension 3A of the rolled plate is larger than the drive side tension 4A and the operator side rolling load 5A of the rolling mill is larger than the drive side rolling load 6A, the gain of the proportional integration control system is made small by means of the fuzzy inference such that a leveling amount is output which slightly increases the screw-down degree of the rolling mill at the operator side.

(b) If the operator side tension 3A of the rolled plate is larger than the drive side tension 4A and the operator side rolling load 5A of the rolling mill is smaller than the drive side rolling load 6A, the gain of the proportional integration control system is made large by means of fuzzy inference such that a leveling amount is output which greatly increases the screw-down degree of the rolling mill at the operator side.

(c) If the operator side tension 3A of the rolled plate is smaller than the drive side tension 4A and the operator side rolling load 5A of the rolling mill is larger than the drive side rolling load 6A, the gain of the proportional integration control system is made large by means of the fuzzy inference such that a leveling amount is output which greatly increases the screw-down degree of the rolling mill at the drive side.

(d) If the operator side tension of the rolled plate is smaller than the drive side tension 4A and the operator side rolling load of the rolling mill is smaller than the drive side rolling load, the gain of the proportional integration control system is made small by means of the fuzzy inference such that a leveling amount is outputted which slightly increases the screw-down degree of the rolling mill at the drive side.

In the embodiment shown in FIG. 4, in accordance with the tension difference 12A after the dead zone process and the rolling load difference 14A after the dead zone process, a fuzzy inference device calculates by means of a fuzzy inference scheme the gain of the proportional integration control system, in the form of a correction factor 23A relative to the tension difference 12A. The fuzzy inference scheme used by the fuzzy inference device 23 for calculating the correction factor 23A will be described later. A multiplier 21 multiplies the tension difference 12A by the correction factor 23A to thereby obtain a corrected tension difference 21A which is then input to a proportional integrator 22. An output of the proportional integrator 22 is input as a leveling amount 22 to an upper/lower limiter 16. The elements including those from the upper/lower limiter 16 to roll gap position drivers 7 and 8 are constructed in the same manner as the embodiment shown in FIG. 2.

Next, the fuzzy inference scheme carried out by the fuzzy inference device 23 will be described. The definition of the fuzzy inference rules and membership functions used for the fuzzy inference is the same as the first embodiment.

Figure 5:
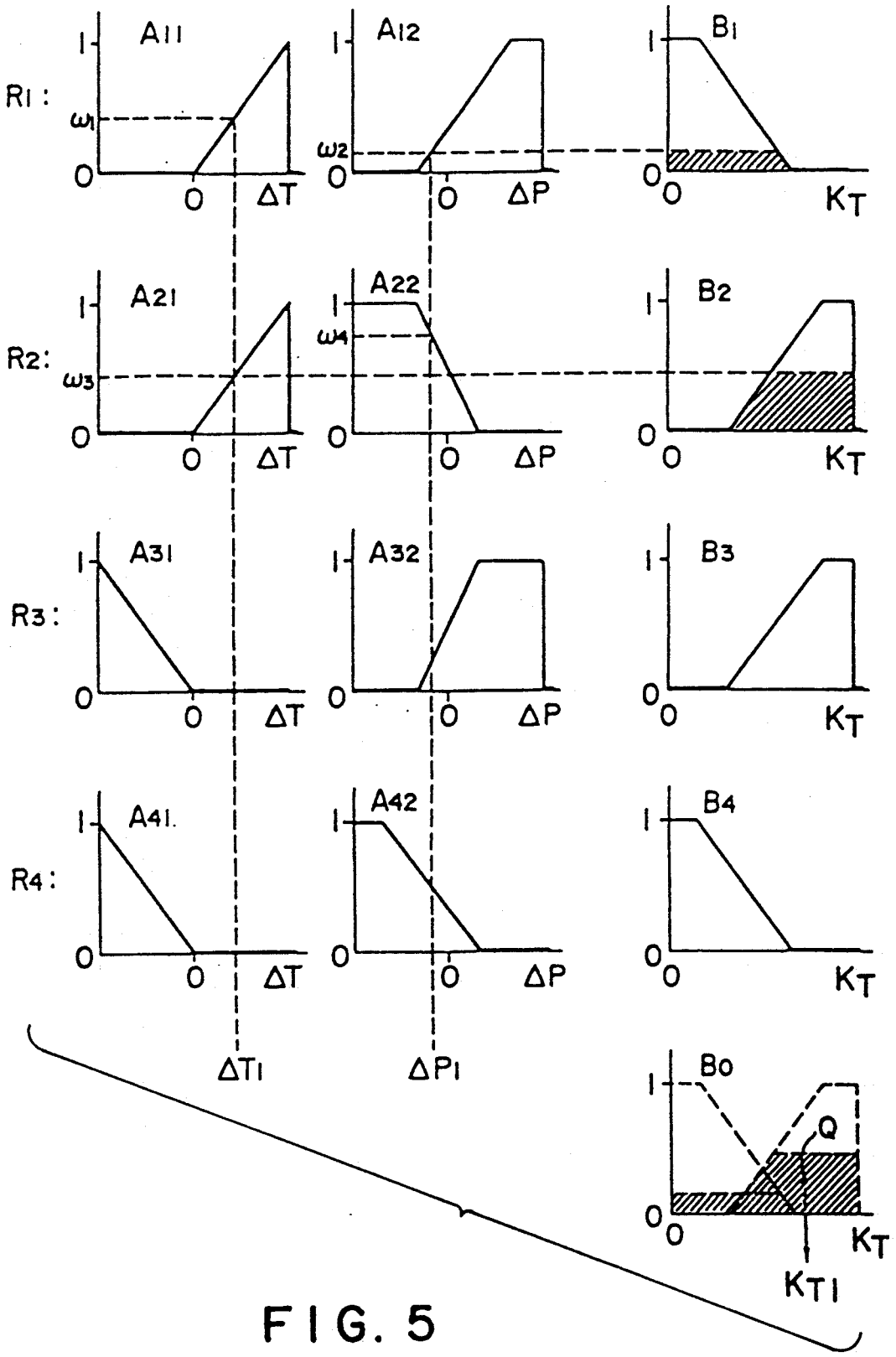
FIG. 5 shows diagrams used for explaining the operation of fuzzy inference for the steering control apparatus shown in FIG. 4.

Referring to FIG. 5, the hatching portions of the membership functions $B_1$, $B_2$, $B_3$, and $B_4$ indicate the values of the gain inferred by the fuzzy inference rules $R_1$, $R_2$, $R_3$, and $R_4$. Therefore, in the example shown in FIG. 5, the $K_T$ coordinate ($=K_{T1}$) of the center of gravity Q of the shape of a membership function $B_0$ obtained by superposing the hatching portions of the membership functions $B_1$ and $B_2$ inferred by the fuzzy control rules $R_1$ and $R_2$, respectively, becomes an optimum gain, i.e., correction factor 23A of the rolling mill 2 for correcting the snaking thereof, for the case of the tension difference $\Delta T=\Delta T_1$ and the rolling load difference $\Delta P=\Delta P_1$.

The fuzzy inference device 23 shown in FIG. 4 infers the total gain of the proportional integrator 22. It is also possible to construct the fuzzy inference device so as to infer a proportional gain and an integration gain, independently.

The membership functions $A_{11}$, $A_{12}$, $A_{21}$, $A_{22}$, $A_{31}$, $A_{32}$, $A_{41}$, $A_{42}$, $B_1$, $B_2$, $B_3$, and $B_4$ shown in FIGS. 3 and 5 may take different function configurations as desired in accordance with an actual plant to which the steering control apparatus of the embodiments is applied.

The membership functions $A_{11}$, $A_{21}$, $A_{31}$, and $A_{41}$ shown in FIGS. 3 and 5 indicate the tension differences. The number of such membership functions may be increased as desired in accordance with an actual plant to which the steering control apparatus of the embodiments is applied.

The membership functions $A_{12}$, $A_{22}$, $A_{32}$, and $A_{42}$ shown in FIGS. 3 and 5 indicate the rolling load differences. The number of such membership functions may be increased as desired in accordance with an actual plant to which the steering control apparatus of the embodiments is applied.

The number of the fuzzy inference rules $R_1$, $R_2$, $R_3$, and $R_4$ may be increased in the same manner as above.

I claim:

1. A steering control apparatus for steering a rolled plate comprising:

tension detecting means for detecting an operator side tension of a plate rolled by a rolling mill and a drive side tension thereof;

rolling load detecting means for detecting an operator side rolling load of said rolling mill and a drive side rolling load thereof;

first calculation means for calculating a tension difference between said operator side tension and said drive side tension, respectively detected by said tension detecting means;

second calculation means for calculating a rolling load difference between said operator side rolling load and said drive side rolling load, respectively detected by said rolling road detecting means;

third calculation means for obtaining by means of a fuzzy inference scheme, a leveling amount and its polarity of said rolling mill for the steering control of said rolled plate, on the basis of two inputs, said two inputs being said tension difference calculated by said first calculation means and said rolling load difference calculated by said second calculation means; and means for regulating said leveling amount of said rolling mill independently for the operator side and the drive side, in accordance with said leveling amount and the polarity calculated by said third calculation means.

2. A steering control apparatus according to claim 1, wherein said third calculation means comprises:

fuzzy inference means for calculating, by means of a fuzzy control scheme, a tension difference correction factor for the steering control of said rolled plate, on the basis of both said tension difference calculated by said first calculation means and said rolling load difference calculated by said second calculation means;

multiplication means for calculating a corrected tension difference by multiplying said tension difference calculated by said first calculation means by said tension difference correction factor calculated by said fuzzy inference means; and proportional integration calculation means for obtaining said leveling amount and polarity of said rolling mill by performing a proportional integration calculation of said multiplication means.

3. A steering control apparatus according to claim 1, further comprising a dead zone device provided at an output side of said first calculation means for setting a dead zone for said tension difference calculated by said first calculation means.

4. A steering control apparatus according to claim 1, further comprising a dead zone device provided at an output side of said second calculation means for setting a dead zone for said rolling load difference calculated by said second calculation means.

5. A steering control apparatus according to claim 1, further comprising limiter means provided at an output side of said third calculation means for limiting an upper/lower limit of an output absolute value.

* * * * *